US008316571B1

(12) United States Patent
Holland

(10) Patent No.: US 8,316,571 B1
(45) Date of Patent: Nov. 27, 2012

(54) RIFLE SCOPE INSTALLATION FIXTURE AND METHOD OF USE

(76) Inventor: Darrell Holland, Powers, OR (US)

( * ) Notice: Subject to any disclaimer, the term of this patent is extended or adjusted under 35 U.S.C. 154(b) by 0 days.

(21) Appl. No.: 12/856,141

(22) Filed: Aug. 13, 2010

(51) Int. Cl.
*F41A 23/16* (2006.01)

(52) U.S. Cl. ..... 42/94; 42/108; 89/37.04

(58) Field of Classification Search ..... 42/108, 42/106, 90, 94; 89/37.01, 37.04, 37.09
See application file for complete search history.

(56) References Cited

U.S. PATENT DOCUMENTS

| | | | | |
|---|---|---|---|---|
| 1,928,871 | A * | 10/1933 | Swebilius | 42/16 |
| 2,378,545 | A * | 6/1945 | Fraser et al. | 73/167 |
| 3,908,282 | A * | 9/1975 | Steffan | 42/121 |
| 4,621,563 | A * | 11/1986 | Poiencot | 89/37.04 |
| 5,070,636 | A * | 12/1991 | Mueller | 42/94 |
| 5,442,860 | A * | 8/1995 | Palmer | 42/120 |
| 5,878,504 | A * | 3/1999 | Harms | 42/120 |
| 5,887,374 | A * | 3/1999 | Brass | 42/94 |
| 6,526,687 | B1 * | 3/2003 | Looney | 42/94 |
| 6,813,855 | B2 * | 11/2004 | Pinkley | 42/120 |
| 7,406,794 | B1 * | 8/2008 | Pope, Jr. | 42/94 |
| 7,584,690 | B2 * | 9/2009 | Cauley | 89/37.04 |
| 7,730,824 | B1 * | 6/2010 | Black | 89/37.03 |
| 7,886,474 | B2 * | 2/2011 | Werner | 42/94 |
| 7,946,071 | B2 * | 5/2011 | Cauley | 42/94 |
| 7,963,206 | B2 * | 6/2011 | Bartle | 89/37.04 |
| 7,980,017 | B2 * | 7/2011 | Harman, III | 42/94 |
| 8,006,426 | B1 * | 8/2011 | Carroll | 42/94 |
| 2003/0177685 | A1 * | 9/2003 | Pinkley | 42/135 |
| 2006/0218840 | A1 * | 10/2006 | Cauley | 42/94 |
| 2007/0074440 | A2 * | 4/2007 | Cauley | 42/94 |
| 2008/0134561 | A1 * | 6/2008 | Clouser | 42/113 |
| 2008/0141546 | A1 * | 6/2008 | Strutt et al. | 33/381 |
| 2008/0209790 | A1 * | 9/2008 | Bartle | 42/94 |
| 2009/0026679 | A1 * | 1/2009 | Harman, III | 269/43 |
| 2009/0188146 | A1 * | 7/2009 | Werner | 42/94 |
| 2010/0319234 | A1 * | 12/2010 | Clouser | 42/111 |
| 2011/0167702 | A1 * | 7/2011 | Bietsch | 42/90 |
| 2011/0173868 | A1 * | 7/2011 | Wilson | 42/95 |
| 2011/0252688 | A1 * | 10/2011 | Bietsch | 42/90 |

* cited by examiner

*Primary Examiner* — Benjamin P Lee
(74) *Attorney, Agent, or Firm* — Timothy E Siegel Patent Law, PLLC; Timothy E Siegel

(57) ABSTRACT

A method of installing a rifle scope to a rifle such that when the rifle is transversely level, the vertical line of the scope reticle is aligned with the direction of bullet drop. The method uses a mounting facilitating fixture having a rifle vice and a rifle vice transverse orientation adjustment device. First, the rifle is clamped into the rifle vice and the rifle vice transverse orientation adjustment device is adjusted until the rifle is transversely level. Then, while the rifle is still held in a transversely level position in the rifle vice, a scope having a vertical line in the reticle is connected to the rifle so that the vertical line is plumb in relation to the Earth. Because both the direction of bullet drop and the vertical line of the scope reticle are aligned with gravity, they are aligned with each other.

12 Claims, 3 Drawing Sheets

RIFLE SCOPE INSTALLATION FIXTURE AND METHOD OF USE

BACKGROUND

It is very important that a rifle scope be installed on a rifle so that when the rifle is level, the vertical line of the scope reticle is aligned plumb (i.e., perpendicular) relative to the Earth. This relationship ensures that when the scope's elevation dial is adjusted the resultant changes in bullet impact points will coincide with the direction of bullet drop, which is determined by gravity. If the scope is installed such that when the rifle is level the vertical line of the scope reticle does not mirror the direction of bullet drop, a windage (or horizontal) error is progressively introduced as the scope's elevation dial is adjusted for greater bullet drop. Despite this need, there appears to be no fixture adapted to facilitating scope installation so that this requirement is met.

During scope installation, a rifle is typically placed in a cradle or vise. Ideally, the rifle is oriented so that the top of the receiver (or the scope base attached thereto) is level when evaluated in a direction perpendicular to the long axis of the rifle (transversely level). Unfortunately, maintaining this orientation until scope installation is complete is problematic. Cradles normally don't provide a means of securing the rifle in the proper position, and vises can disturb the rifle as they are tightened. These shortcomings frequently result in the expenditure of time and energy, as multiple attempts to maintain and verify the rifle's proper orientation are required. Worse yet, a frustrated installer may, at some point, intentionally or not, mount the scope on an improperly positioned rifle.

When a scope has been properly installed and the rifle is held level, as the scope's elevation dial is adjusted bullet impact at a fixed range will vary, but it will do so strictly in conformance with the direction of bullet drop. However, when a scope has been installed so that, when the rifle is level, the vertical line of the scope reticle is not plumb, a windage (horizontal) error is introduced. That is: as the elevation dial is adjusted, bullet impact is moved laterally, as well as vertically. This built-in windage error would not be evident to the shooter, and it would lead to decreased shooting accuracy, especially at longer shooting distances.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention is a method of installing a rifle scope to a rifle such that, when the rifle is transversely level, the vertical line of the scope reticle is aligned plumb relative to the Earth. The method uses a mounting facilitating fixture having a rifle vise and a rifle vise transverse orientation adjustment device. First, the rifle is clamped into the rifle vise and the rifle vise transverse orientation adjustment device is adjusted until the top of the rifle's receiver (or scope base attached thereto) is level when evaluated in a direction perpendicular to the long axis of the rifle (transversely level). The proper rifle orientation can be verified using a so-called "torpedo" level or a small, specialty bubble level. Then, while the rifle is still held in this orientation in the rifle vise, a scope is connected to the rifle so that the vertical line of the scope reticle is plumb relative to the Earth.

This is accomplished by viewing a plumb line on a distant wall through the scope, and aligning the vertical line of the scope reticle with the plumb line. Because both the direction of bullet drop and the vertical line of the scope reticle are aligned with gravity, they are aligned with each other.

In a second separate aspect, the present invention is a fixture for facilitating the attachment of a scope to a rifle, with a minimum of misalignment between the vertical line of the scope reticle and the direction of bullet drop, which is determined by gravity. The fixture includes a rifle vise, including a bottom wall, extending at least 6 cm in a longitudinal dimension, a side wall extending at least 6 cm in the longitudinal dimension, a support and a threaded aperture structure supported by the support and defining a horizontal threaded aperture. A threaded bolt extends through the threaded aperture and is available to be tightened to clamp a rifle against the side wall. A rigid arm is attached to the rifle vise and defines a vertical threaded aperture. Also, a threaded bolt extends through the vertical threaded aperture and is rotatable to change the orientation of the rifle vise when the fixture is mounted on a planar surface, thereby permitting a user to place the rifle into a transversely level position.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENT(S)

Figures 1, 2:
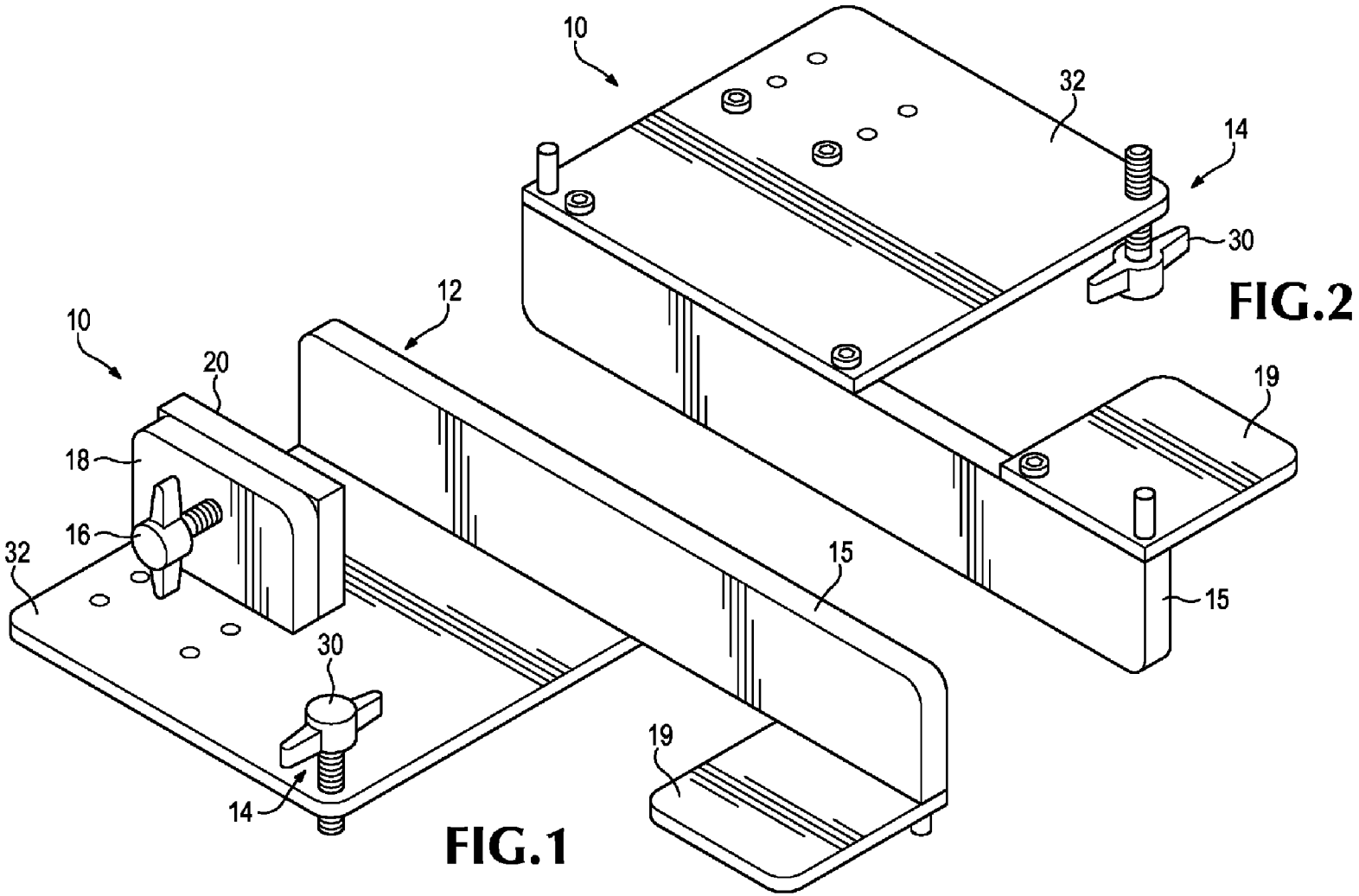
FIG. 1 is a top perspective view of a rifle scope installation fixture according to the present invention.
FIG. 2 is a bottom perspective view of the fixture of FIG. 1.
Figure 3:
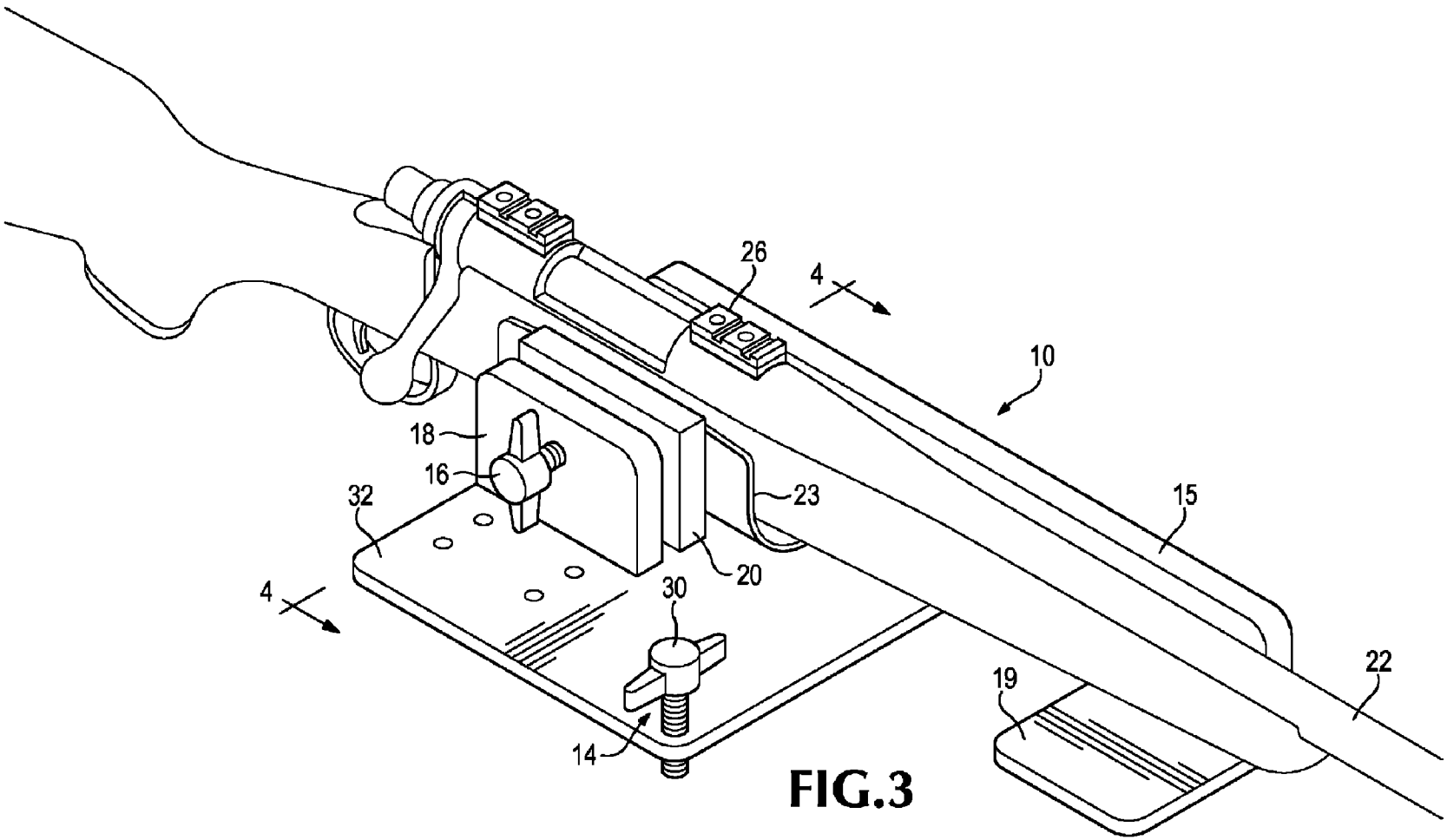
FIG. 3 is a top perspective view of the fixture of FIG. 1, with a rifle clamped in it.
Figure 4:
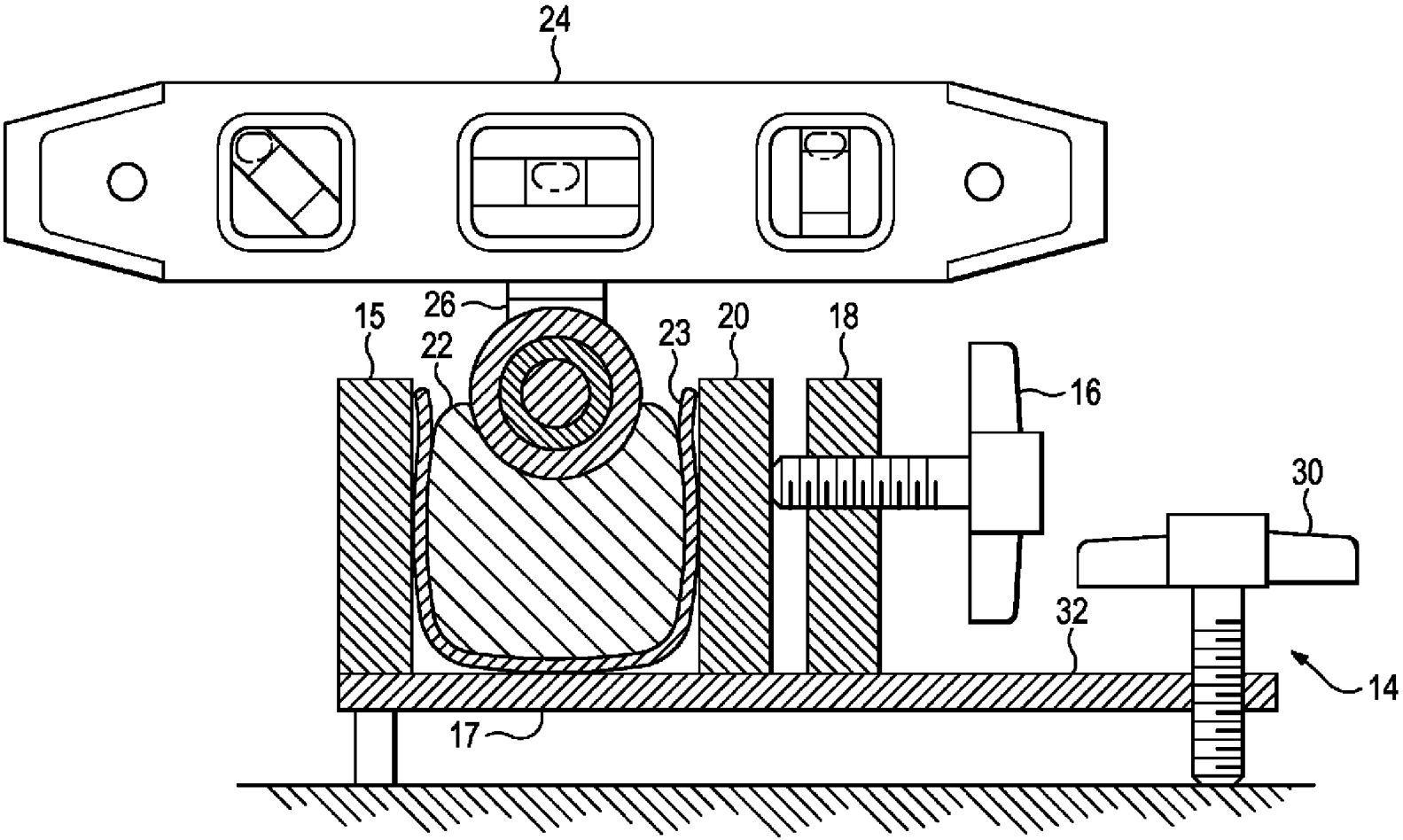
FIG. 4 is a front view of the fixture of FIG. 1, with a rifle clamped in it and a level placed on top of a scope mounting base attached to the rifle.

Referring to FIG. 1, a preferred embodiment of a scope-mounting facilitating fixture 10, according to the present invention, includes a rifle vise 12 and a rifle vise angle adjust 14. Vise 12 includes a side wall 15, a bottom wall 17, a forward rifle stock rest 19, and a threaded bolt 16 fit into a threaded aperture defined in a support 18 that is anchored to bottom wall 17. Bolt 16 when rotated so that it moves inwardly, presses against a block 20, which presses a rifle 22 (FIG. 3) against side wall 15, securely clamping rifle 22 in place. In a preferred embodiment bolt 16 engages with a divot (not shown) defined in the surface of block 20. A flexible sheet 23 (FIG. 4), such as a cloth or a polymeric foam web may be used in vise 12 to prevent damage to the stock of rifle 22. Block 20 can be made of tough but resiliently compressible material, so that it can deform slightly to conform to the shape of the side of a rifle, thereby creating a better grip, but not be damaged in the process. A tough polymeric foam, such as polystyrene, polymethyl methacrylate, polyurethane, phenol- or urea-formaldehyde resins, polyethylene, polypropylene or styrene-acrylonitrile copolymers can be used for block 20, although wood would also function adequately.

Vise angle adjust 14 comprises a threaded bolt 30 that is fit through a threaded aperture that is rigidly connected to vise 12 by an arm 32, which in fixture 10 is unitary to bottom wall 17, so that arm 32 and bottom wall 17 are one continuous planar substrate, or stated in a slightly different manner, a board. Once a rifle 22 is clamped tightly in vise 12, vise angle adjust 14 is used to change the angle of fixture 10 until a level 24 placed atop a mounting block 26 shows that the mounting block is transversely level. At this point the rifle is in the proper orientation for scope installation. Adjust 14 makes it unnecessary for rifle 22 to be clamped perfectly transversely level in vise 12, a task that was heretofore necessary and frequently quite challenging to scope installers.

Skilled persons will be aware of mounting rings, which are typically provided in two pieces, a lower half defining an upwardly directed semicircle and an upper piece defining a downwardly directed semicircle, that are fastened together about a scope. Accordingly, the lower halves of the mounting rings are attached to mounting blocks 26 and 28, a scope is placed in these rings and the top halves of the rings are fastened loosely about the scope, permitting scope rotation within the rings. Next, the scope is rotated so that the vertical line of the scope reticle is aligned to a plumb line as visualized on a nearby wall. A plumb bob, which in a preferred embodiment, is included in a kit to create the plumb line and facilitate the aligned mounting of a rifle scope.

Once the vertical line of the scope reticle is aligned plumb to the Earth, the mounting rings are tightened into place. With the rifle transversely level and the vertical line of the scope reticle plumb, the vertical line of the scope reticle is now aligned with the direction of bullet drop. Accordingly, any subsequent changes effected via the scope's elevation dial will not introduce a windage (horizontal) error, so long as the rifle is level. To ensure that the rifle is level while aiming, an after-market specialty level may now be attached to the scope. If the level is properly installed, the shooter can have confidence that when this level reads "level," the vertical line of the scope reticle will be aligned with the direction of bullet drop.

While a number of exemplary aspects and embodiments have been discussed above, those possessed of skill in the art of scope installation will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A method of installing a rifle scope to a rifle having a scope mounting location, such that, when the rifle is transversely level, the vertical line of the scope reticle is aligned with the direction of bullet drop, comprising:

(a) providing a mounting facilitating fixture having a front and back and a rifle vise including a rifle vise bottom wall and a rifle vise side wall, extending upwardly from said bottom wall, that defines a longitudinal/vertical plane, and a rifle stock rest, in front of and rigidly affixed to said rifle vise by an intermediate member, but separated therefrom by a space and including a rifle stock rest bottom wall and a rifle stock rest side wall that is aligned to said rifle vise side wall, and a pair of supporting legs aligned parallel to said longitudinal/vertical plane a first said supporting leg extending downwardly from said rifle vise bottom wall and a second said supporting leg extending downwardly from said rifle stock rest bottom wall, and a rifle vice transverse orientation adjustment device having a single, height-adjustable leg, supporting said fixture in conjunction with said pair of supporting legs;

(b) clamping said rifle into said rifle vise, at said scope mounting location, and adjusting said rifle vise transverse orientation adjustment device until said rifle is transversely level; and, (c) while said rifle is still held in a transversely level position in said rifle vise, connecting a scope having a vertical line in the reticle to said rifle so that said vertical line is plumb in relation to the Earth.

2. The method of claim 1, wherein said reticle is compared with an independent plumb line to ensure that said vertical line of the reticle is plumb in relation to the Earth.

3. The method of claim 1, wherein said facilitating fixture includes a bottom wall that defines a threaded aperture and said rifle vise transverse orientation adjustment device is a vertical threaded bolt that extends through said threaded aperture, and which is turned to move a point on said rifle vise up or down, thereby changing the orientation of said rifle vise.

4. The method of claim 1, wherein said rifle vise includes a first vertical wall and a second vertical wall defining a threaded aperture, a threaded bolt extends through said threaded aperture, and presses against a block of hard material interposed between said rifle and said threaded bolt, to hold said rifle against said first vertical wall.

5. The method of claim 1, wherein said adjusting said rifle vise transverse orientation adjustment fixture until said rifle is transversely level includes providing a level, placing said level on top of said rifle's receiver (or scope base attached thereto) and viewing said level to determine if said rifle is transversely level.

6. The method of claim 5, wherein said level includes a magnet and is magnetically attached to said rifle receiver (or scope base attached thereto).

7. A fixture for facilitating the attachment of a scope to a rifle so that when the rifle is transversely level there will be a minimum of misalignment between the vertical line of the scope reticle and the direction of bullet drop, said fixture having a front and a back and being adapted to be used in a particular vertical orientation defining upward and downward directions and comprising:

(a) a rifle vise, including a rifle vise bottom wall, extending at least 6 cm in a longitudinal dimension, a rifle vise side wall extending upwardly from said bottom wall and extending at least 6 cm in said longitudinal dimension, a support attached to said bottom wall, and a threaded aperture structure supported by said support and defining a horizontal threaded aperture;

(b) a threaded bolt extending through said threaded aperture and being available to be tightened to clamp a rifle;

(c) a rigid arm attached to said rifle vise and defining a vertical threaded aperture; and (d) a threaded bolt extending through said vertical threaded aperture and being rotatable to change the orientation of said rifle vise when said fixture is mounted on a planar surface, thereby permitting a user to place said rifle into a transversely level position; and (e) a rifle stock rest, forward of and rigidly attached to said rifle vise and including a rifle stock rest bottom wall and a rifle stock rest side wall, aligned to said rifle vise side wall.

8. The fixture of claim 7, wherein said rifle vise side wall is a first rifle vise sidewall and said support is a second rifle vise sidewall, and said horizontal threaded aperture is supported in said second sidewall.

9. The fixture of claim 7, wherein said arm is unitary to said rifle vise bottom wall, so that said bottom wall and said arm form a continuous substrate.

10. The fixture of claim 7, wherein said rifle vise sidewall is rigidly attached to said rifle stock rest side wall by an intermediate side wall.

11. The method of claim 1, wherein said intermediate member is an intermediate side wall, connecting said rifle vise side wall and said rifle stock rest side wall.

12. The method of claim 11, wherein said intermediate side wall is unitary to said rifle vise side wall and said rifle stock rest side wall.

* * * * *